US005979426A

United States Patent [19]

Troklus et al.

[11] Patent Number: 5,979,426

[45] Date of Patent: Nov. 9, 1999

[54] BALL THROWING MACHINE

[75] Inventors: Joey Troklus; Ronald Stone, both of Louisville, Ky.

[73] Assignee: Boyz, Inc., Louisville, Ky.

[21] Appl. No.: 09/065,177

[22] Filed: Apr. 23, 1998

Related U.S. Application Data

[60] Provisional application No. 60/044,893, Apr. 25, 1997.

[51] Int. Cl.[6] ..... F41B 4/00

[52] U.S. Cl. ..... 124/78

[58] Field of Search ..... 124/78

[56] References Cited

U.S. PATENT DOCUMENTS

| | | | |
|---|---|---|---|
| D. 340,491 | 10/1993 | Nass | D21/210 |
| 4,372,284 | 2/1983 | Shannon et al. | 124/78 |
| 4,442,823 | 4/1984 | Floyd et al. | 124/78 |
| 4,531,504 | 7/1985 | Gilreath | 124/78 |
| 4,596,230 | 6/1986 | Griffith | 124/78 |
| 4,646,709 | 3/1987 | Kholin | 124/82 |
| 4,712,534 | 12/1987 | Nozato | 124/78 |
| 4,823,763 | 4/1989 | Ponza | 124/78 |
| 4,834,060 | 5/1989 | Greene | 124/78 |
| 4,995,371 | 2/1991 | Kuizinas | 124/7 |
| 5,125,653 | 6/1992 | Kovacs et al. | 124/78 |
| 5,464,208 | 11/1995 | Pierce | 124/78 X |

FOREIGN PATENT DOCUMENTS

| | | | |
|---|---|---|---|
| 2582526 | 12/1986 | France | 124/78 |
| 2095565 | 10/1982 | United Kingdom | 124/78 |

*Primary Examiner*—John A. Ricci

*Attorney, Agent, or Firm*—Theresa Fritz Camoriano; Camoriano and Associates

[57] ABSTRACT

A ball throwing machine includes a ball throwing mechanism that is mounted on a frame that rotates about a vertical axis so that balls are ejected at preset positions along an arc. In a preferred embodiment, the ball throwing mechanism is mounted on a base plate that rotates back and forth through a 90-degree arc. A timing plate controls the rotation of the throwing mechanism and includes projections that trigger the ejection of the balls at preselected angular positions.

8 Claims, 12 Drawing Sheets

BALL THROWING MACHINE

This application claims priority from U.S. Provisional application 60/044,893, filed Apr. 25, 1997.

BACKGROUND OF THE INVENTION

The present invention relates to a ball throwing machine. Many ball throwing devices have been developed over the years. Almost all baseball or softball players are familiar with pitching machines that are used in batting practice. These machines take the place of the pitcher, throwing balls in the limited area of the strike zone. When teams are practicing their fielding skills, a coach typically stands at home plate and attempts to hit ground balls to the infielders with a bat. While the coach is hitting balls to the infielders, he cannot be personally working with his players. There are some ball-throwing machines that can throw balls in a wide variety of directions and are computer controlled. However, these machines are complicated, are not intended for use with baseballs, and are too expensive to be usable by most baseball teams. It would be desirable to provide an inexpensive ball throwing machine that could take the place of the batter in baseball practice, throwing practice ground balls to the infielders as part of defensive practice drills for baseball or softball players.

SUMMARY OF THE INVENTION

The present invention is a simple, inexpensive ball throwing machine that ejects balls at preset positions along an arc, permitting the machine to be used as a baseball practice device. In a preferred embodiment, the ejecting mechanism is mounted on a table that rotates from the first-base line to the third-base line and back. A timing plate controls this rotation and includes projections which trigger the ejection of the balls at appropriate angular positions. A ball is thus thrown to each infielder in turn.

Figure 1:
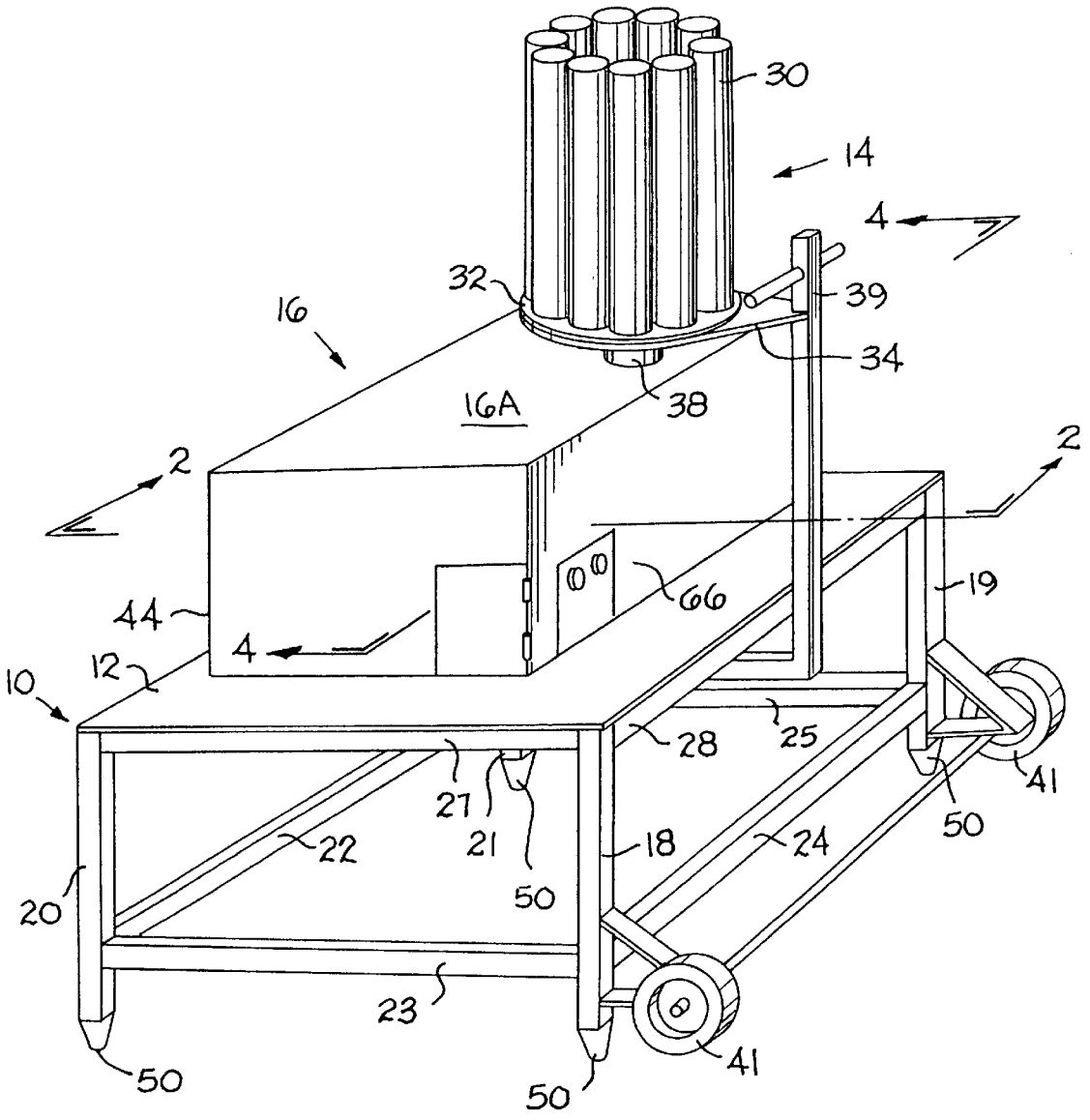
FIG. 1 is a perspective view of a ball throwing machine made in accordance with the present invention.

DESCRIPTION OF THE PREFERRED EMBODIMENT:

FIGS. 1–12 show a preferred embodiment of the present invention. This embodiment comprises a simple first frame 10, which rests on the ground. A ball hopper 14 is mounted on the frame 10. A second frame 16, containing the ejecting wheels 68, 70, is pivotably mounted on the first frame 10. In this preferred embodiment, the first frame 10 is defined by four vertical legs 18, 19, 20, 21, each of which extends from the ground to a platform 12. The platform 12 is preferably a steel plate. The second frame 16, including the throwing mechanism, is mounted on the platform 12, as will be described later. The lower portions of the vertical legs 18, 19, 20, 21 are connected by four lower horizontal members 22, 23, 24, 25 which form a rectangle. Similarly, four upper horizontal members 26, 27, 28, 29 connect the top ends of the vertical legs 18, 19,20, 21. The platform 12 is preferably welded or similarly secured to these upper horizontal members 26, 27, 28, 29. The vertical legs and upper and lower horizontal members preferably are to be constructed of 1½" square steel tubing or material with similar structural strength. Also, in the preferred embodiment, a foot 50 is attached to the bottom end of each vertical leg 18, 19, 20, 21. Each foot 50 is essentially an inverted square pyramid welded to the ends of the vertical legs 18, 19, 20, 21 to provide support to the structure. As best shown in FIG. 1, wheels 41 may also be mounted to two adjacent vertical legs 18, 19. A handle bracket 39 is also preferably fixed relative to the frame 10 by welding, bolting, or other means. The wheels 41, in conjunction with the handle 39, allow a user to easily transport the ball throwing machine. A user simply pulls back on the handle 39, pivoting the entire machine, until the front legs 20, 21 are lifted from the ground and the machine is resting solely on the wheels 41. The wheels 41 and handle 39 then serve as a built-in dolly, allowing the user to move the machine around.

Figure 2:
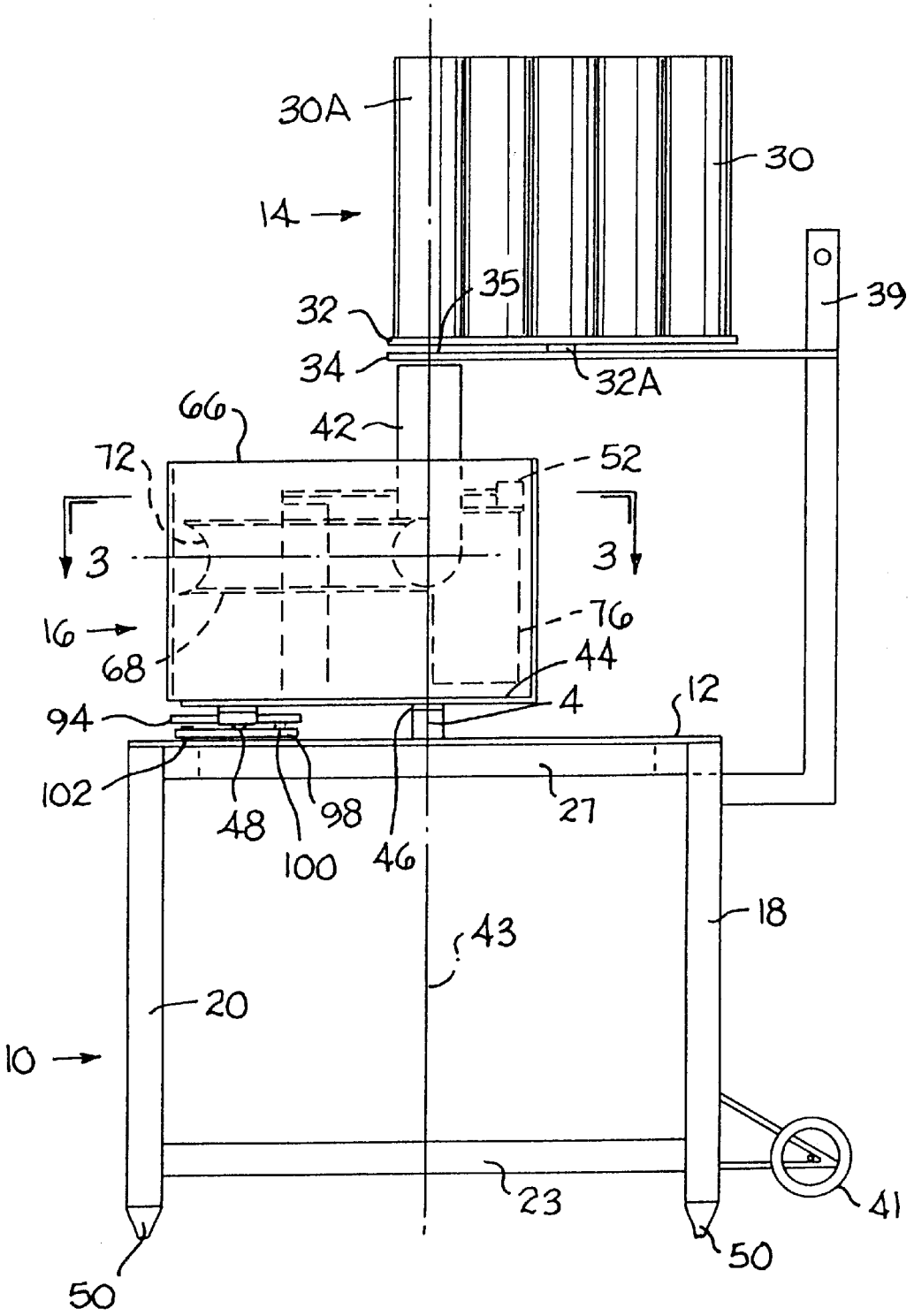
FIG. 2 is a view of the ball throwing machine taken along line 2—2 of FIG. 1.
Figure 2A:
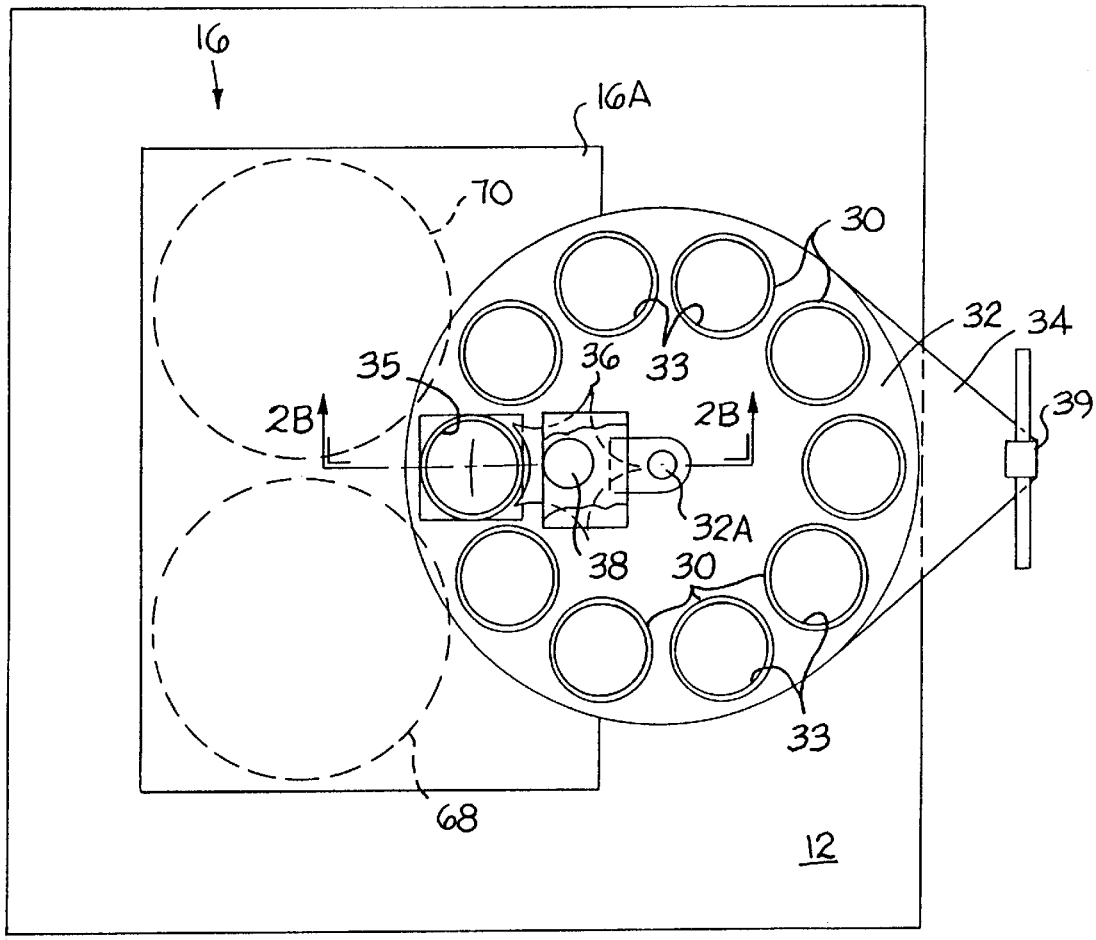
FIG. 2A is a top view of the ball throwing machine of FIG. 1.
Figure 2B:
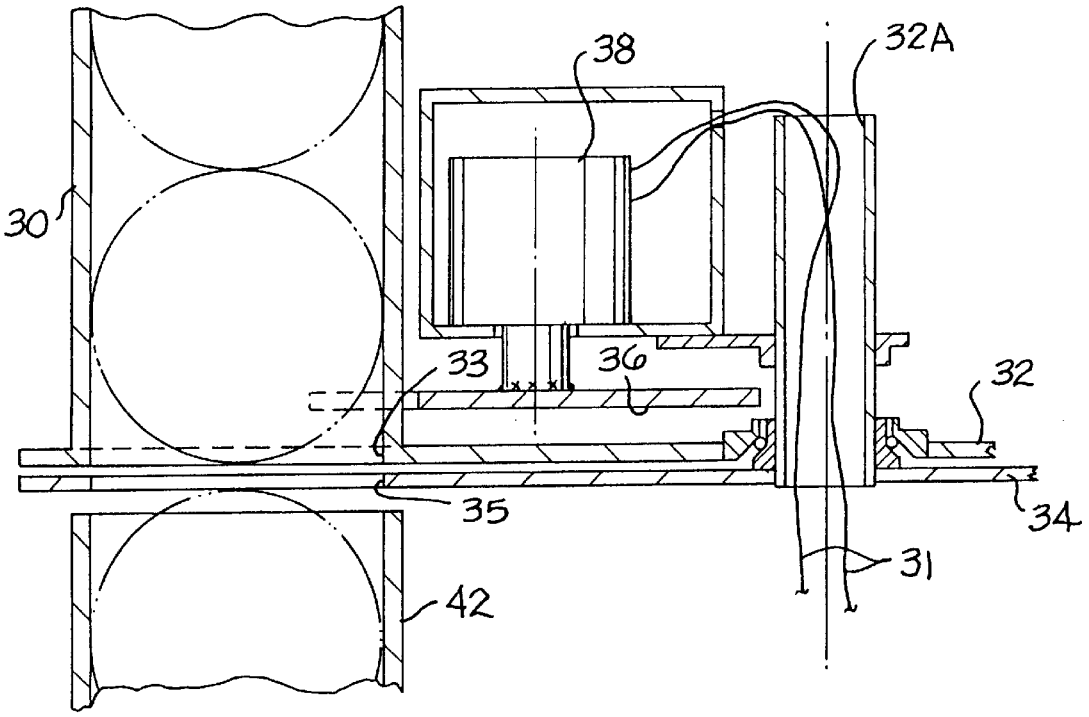
FIG. 2B is a view taken along the line 2B—2B of FIG. 2A.

Referring now to FIGS. 2, 2A, and 2B, the hopper 14 of the present embodiment preferably comprises a plurality of vertical tubes 30 welded to an upper plate 32. Each tube 30 has a diameter slightly greater than that of the type of ball to be ejected—3½" for a standard baseball. This upper plate 32 is spaced from and rotatably mounted on a lower plate 34 by means of a hollow shaft 32A. One end of the hollow shaft 32A is fixed to the lower plate 34 and extends up through a hole and bearing in the upper plate 32. The lower plate 34 is welded to the handle bracket 39 of the ball throwing machine, thereby fixing the lower plate 34 relative to the first frame 10.

As shown in FIGS. 2A and 2B, there are circular openings 33 in the upper plate 32 that allow balls housed in the tubes 30 to pass through the upper plate 32. These openings 33 have a diameter corresponding to that of the tubes 30. There is only a single opening 35 in the lower plate 34, and that opening 35 is aligned with the upper distal end of a ball drop chute 42, leading through the top wall 16A of the second frame 16 to the ejecting wheels 68,70. Thus, balls housed in a tube 30A drop through the opening 35 and are fed into the ejecting wheels 68, 70 only when that particular tube 30A is aligned with the opening 35 defined by the lower plate 34.

To rotate the hopper 14, so that balls from other tubes can fall into the ball drop chute 42, a drive motor 38, positioned within the internal space defined by the tubes 30, and mounted on the upper end of the shaft 32A, drives a sprocket 36. The sprocket 36, in turn, contacts the outside surfaces of the tubes 30 and pushes the tubes 30 into position, indexing the tubes by rotating the upper plate 32 about the hollow shaft 32A. The wires 31 from a power source to the drive motor 38 extend upwardly through the hollow shaft 32A. The drive motor 38 is controlled by a timer 39 (shown in FIG. 12), so that it is turned on briefly, rotates the sprocket 36 to its next position, causing the next tube 30 to be aligned with the opening 35, stops so that some balls can fall from one tube into the ball drop chute 42, then is turned on again to rotate the sprocket 36 to its next position, and so forth. The timer 39 is set so that the balls are supplied at the speed needed by the machine. In the preferred embodiment, the hopper 14 includes ten tubes 30, each of which holds eight balls.

Figure 9:
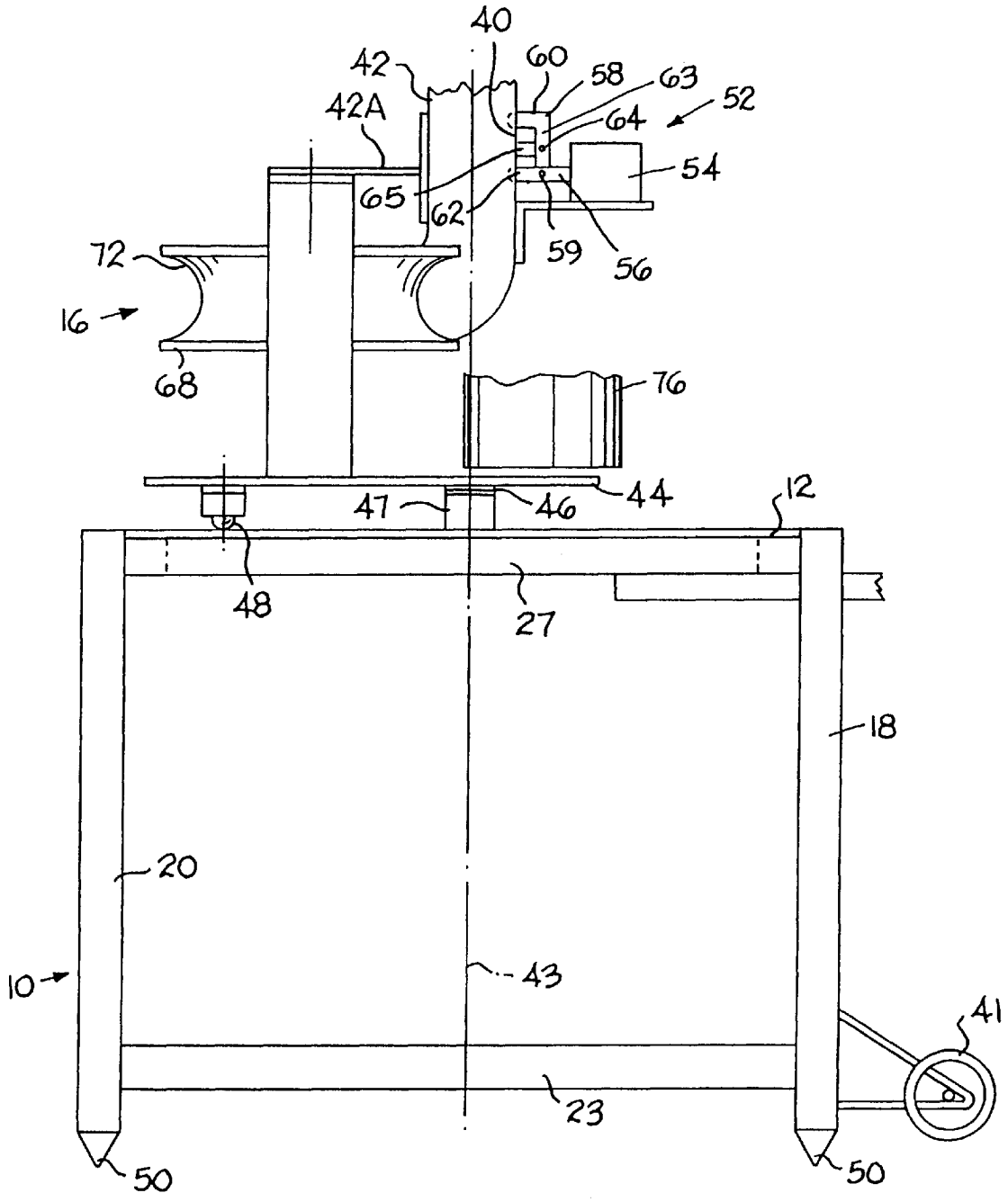
FIG. 9 is the same view as FIG. 2 but with some portions broken away to show the ball release.

Referring now to FIGS. 2 and 9, it may be seen that the ball drop chute 42 is a curved tube through which balls pass from the ball hopper 14 to the ejecting wheels 68, 70. The ball drop chute 42 is fixed to a bracket 42A, which is fixed to the second frame 16, so the ball drop chute 42 rotates with the second frame 16. The axis of rotation 43 of the second frame 16 is the same as the central axis 43 of the ball drop 42, so the ball drop chute 42 remains directly below the hole 35 in the lower plate 34 as the second frame 16 pivots.

Figure 3:
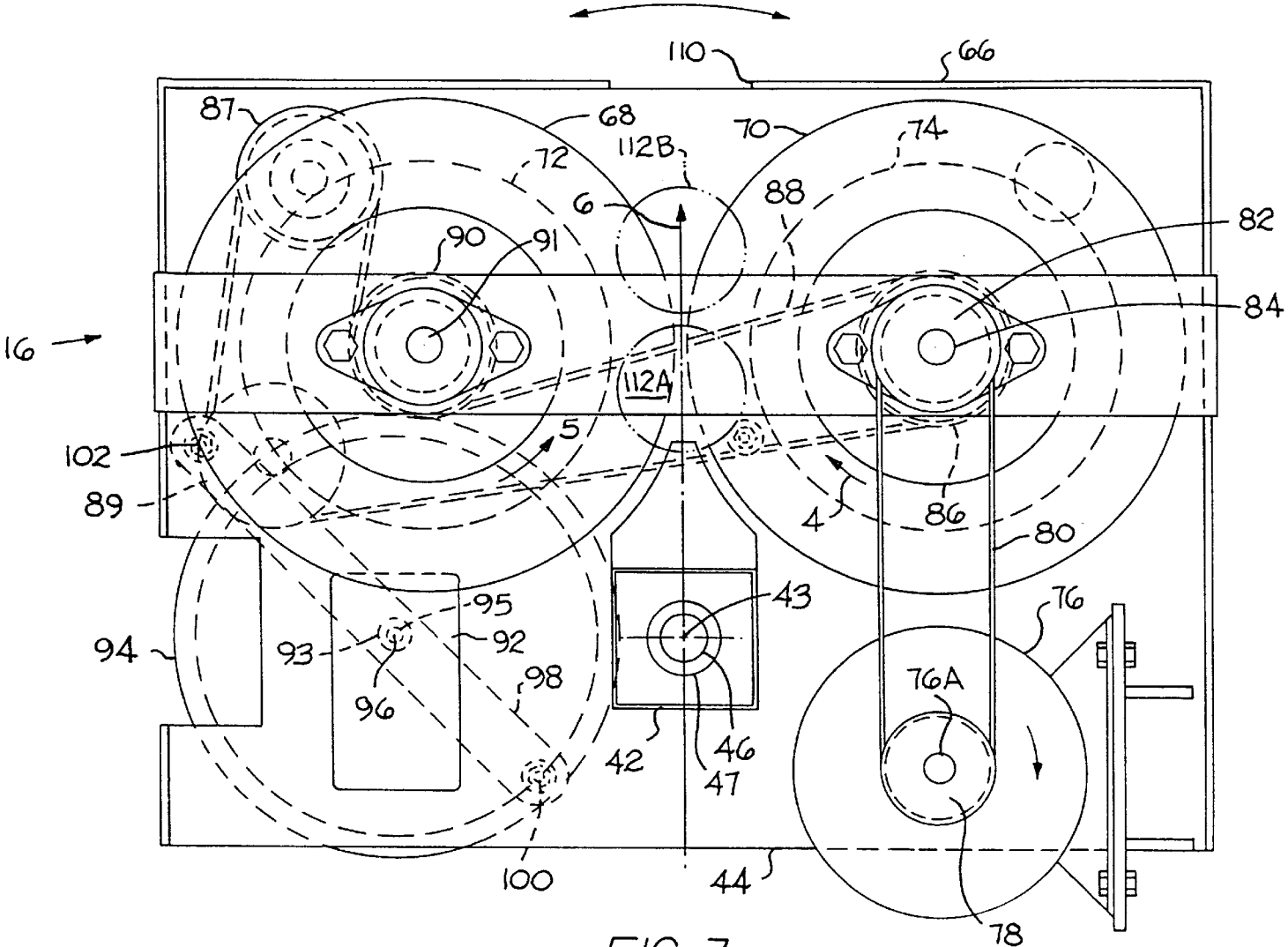
FIG. 3 is a sectional view of the ball throwing machine taken along line 3—3 of FIG. 2.
Figure 4:
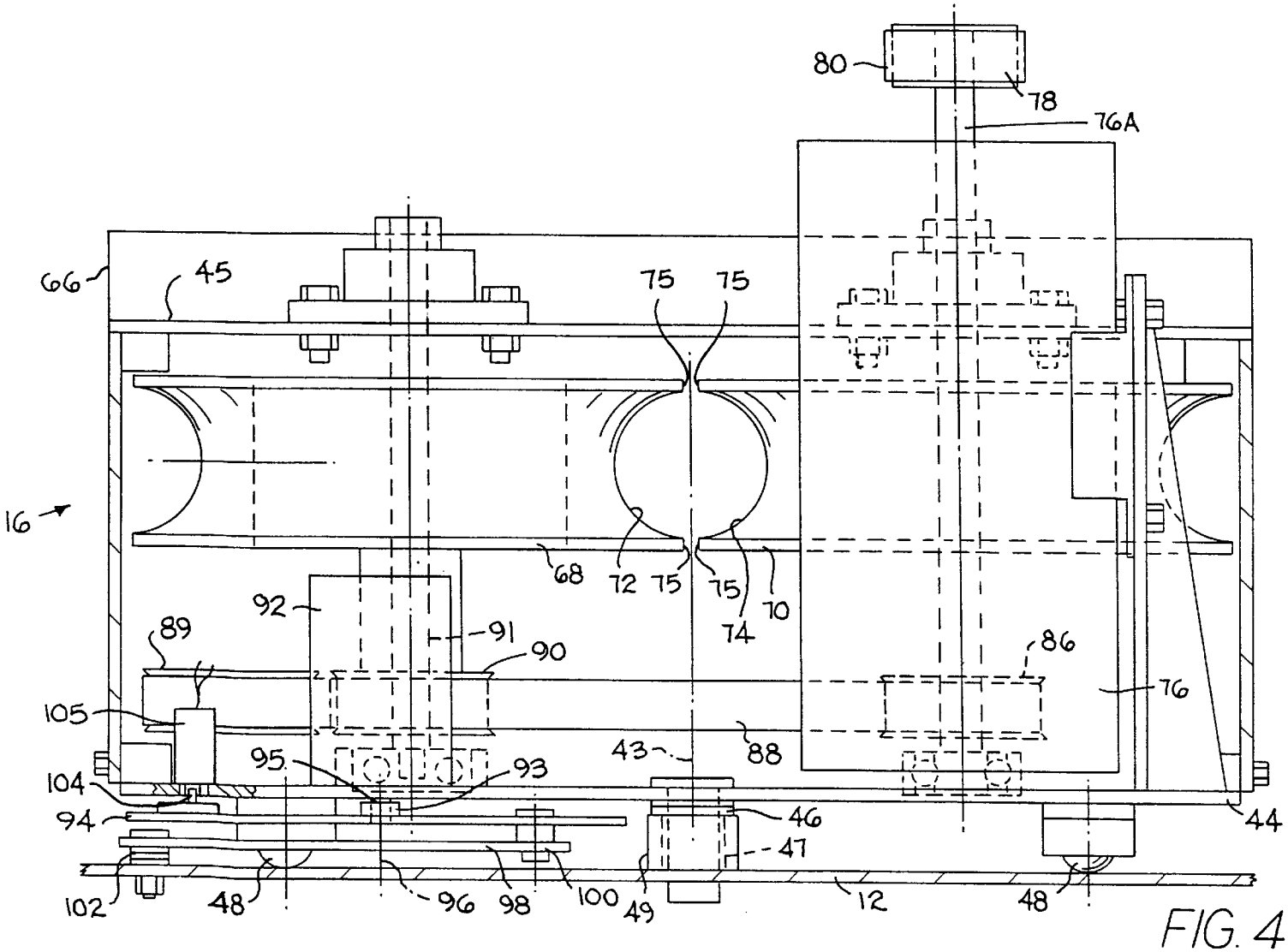
FIG. 4 is a sectional view of a portion of the ball throwing machine taken along line 4—4 of FIG. 1.
Figure 6:
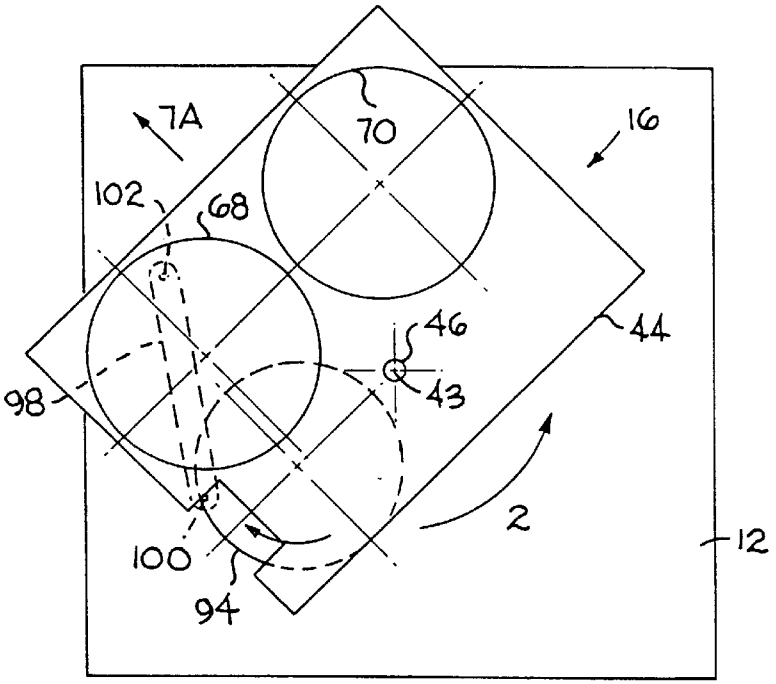
FIG. 6 is a schematic plan view of the ball throwing mechanism of the machine of FIG. 1, wherein the timing plate and ejecting wheels are oriented in a second position.

The Ejecting Wheel Drive:

FIGS. 3 and 4 are detailed views of the second frame 16 and the throwing mechanism mounted within the second frame 16. There is a simple sheet metal housing 66 enclosing the second frame 16 and the throwing mechanism. The second frame 16 includes a base plate or table 44. An axle 46 is fixed to the base plate 44 and projects downwardly therefrom. The axle 46 is received by a cylindrical collar 47, which is fixed to the platform 12 on the first frame 10, so the second frame 16 pivots relative to the first frame 10 about the axis 43 of the axle 46. To facilitate smooth rotation of the axle 46 within the collar 47, a bearing 49 is preferably fit into the collar 47, as shown in FIG. 4. The second frame 16 is further supported on the platform 12 by a plurality of ball casters 48 that are attached to the underside of the base plate 44 and roll along the platform 12.

Two ejecting wheels 68, 70 are mounted on the second frame 16 between the base plate 44 and the upper surface 16A of the housing 66, so as to rotate about parallel, vertical axes. The shaft 84 of the ejecting wheel 70 is shown on the right in FIG. 3, and is directly behind the shaft 76A on the right of FIG. 4. The shaft 91 of the ejecting wheel 68 is shown on the left in FIGS. 3 and 4. The ejecting wheels 68, 70 are positioned to receive the balls from the ball drop chute 42 and throw the balls through an opening 110 in the housing 66. The ejecting wheels 68, 70 rotate in opposite directions. In the preferred embodiment, the ejecting wheels 68, 70 have semi-circular grooves 72, 74 in their respective outer surfaces. The outer edges 75 of the wheels 68, 70 are separated by only a short distance (¼" in the preferred embodiment). The grooves 72, 74 are sized and spaced apart the proper distance to allow a ball to be grasped between the two wheels 68, 70 and then ejected by the rotation of the wheels 68, 70. FIG. 3 shows a ball 112A in phantom as it is leaving the ball drop chute 42 and is being grabbed by the rotating ejecting wheels 68, 70, and it shows a ball 112B in phantom leaving the ejecting wheels 68, 70, heading out through the opening 110 in the housing 66. When a ball is introduced into the rotating ejecting wheels 68, 70, through the ball drop chute 42, it is pinched between the two wheels 68, 70 and is ejected outwardly in the direction of the arrow 6, due to the rotation of the ejecting wheels 68, 70.

A direct current motor 76, positioned within the housing 66, rotates the ejecting wheels 68, 70 using a belt system. The ejecting wheel drive motor 76 has an output shaft 76A on which is mounted a first timing pulley 78. A first timing belt 80 runs from the first timing pulley 78 to a second timing pulley 82. The second timing pulley 82 and the second ejecting wheel 70 are mounted coaxially about a shaft 84. As the first timing pulley 78 rotates, it drives the first timing belt 80, which in turn drives the second timing pulley 82. The rotation of the second timing pulley 82 turns the shaft 84 and thus rotates the second ejecting wheel 70.

A third timing pulley 86 is also mounted on the shaft 84 below the second ejecting wheel 70. A second timing belt 88 runs from the third timing pulley 86 around a portion of a fourth timing pulley 90 and around first and second idler pulleys 87, 89. The first and second idler pulleys 87, 89 hold the second timing belt 88 in contact with the fourth timing pulley 90. The fourth timing pulley 90 is mounted on the lower end of a second shaft 91, beneath the first ejecting wheel 68, which is also mounted on this shaft 91.

As the first timing pulley 78 rotates clockwise, the first belt 80 causes the second timing pulley 82, and thus the shaft 84, to rotate clockwise. Thus, the first ejecting wheel 70 rotates clockwise, as indicated by arrow 4 in FIG. 3. Since the third timing pulley 86 is also mounted on the shaft 84, it rotates clockwise as well. This clockwise rotation is translated by the second timing belt 88. The contact of the second timing belt 88 against the fourth timing pulley 90 causes a counterclockwise rotation of the fourth timing pulley 90. Since the fourth timing pulley is mounted on the shaft 91 of the second ejecting wheel 68, the second ejecting wheel 68 also rotates counterclockwise, as indicated by arrow 5 of FIG. 3.

The Pivot Drive For Moving the Second Frame Relative to the First Frame:

As was stated earlier, the second frame 16 pivots relative to the platform 12 about a vertical axis 43 defined by the axle 46 (shown in FIGS. 3 and 4). As the second frame 16 rotates, it moves the throwing mechanism back and forth through an arc. As stated above, the vertical axis 43 essentially bisects the circular gap defined by the facing portions of the ejecting wheels 68, 70, so that the chute 42 continues to feed balls into the gap between the ejecting wheels irrespective of the angular disposition of the second frame 16 along the arc.

In the preferred embodiment, a second motor 92 turns a timing plate or disk 94, which causes the second frame 16 to pivot relative to the first frame 10. The output shaft 95 of the timing plate motor 92 extends through the base plate 44 of the second frame 16. This timing plate shaft 95 defines a vertical axis 96. A collar 93 is welded or similarly secured to the center of the timing plate 94 and receives this shaft 95. Thus, the timing plate 94 is mounted such that it rotates as the timing plate shaft 95 rotates, and the timing plate shaft 95 moves with the second frame 16, as the second frame 16 pivots relative to the first frame 10.

Figure 8C:
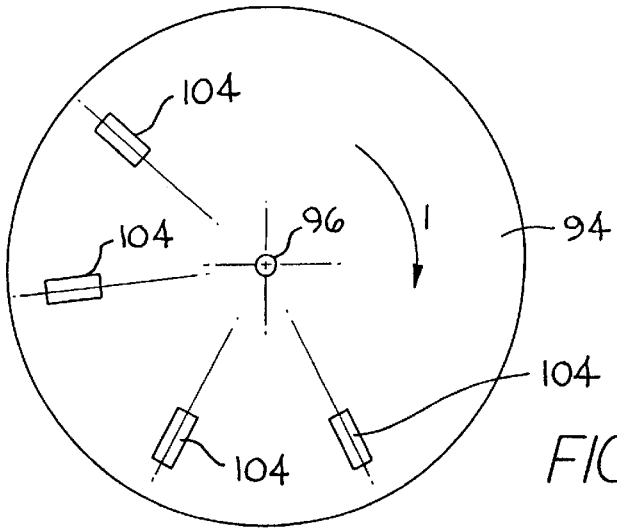
FIG. 8C is a top view of the timing plate shown in FIG. 3.
Figure 7:
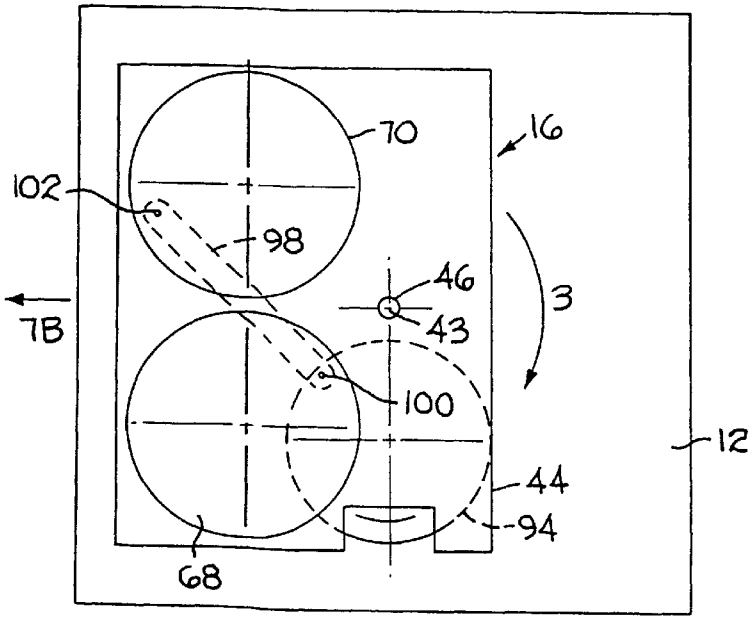
FIG. 7 is a schematic plan view of the ball throwing mechanism of the machine of FIG. 1, wherein the timing plate and ejecting wheels are oriented in a third position.
Figure 8A:
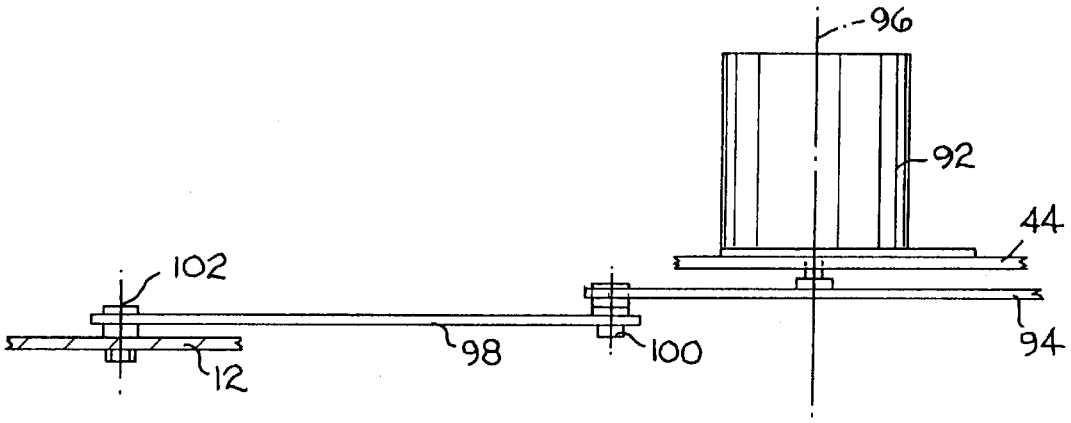
FIG. 8A is an enlarged, broken-away side sectional view showing the timing plate, link, and drive motor of FIG. 4.
Figure 8B:
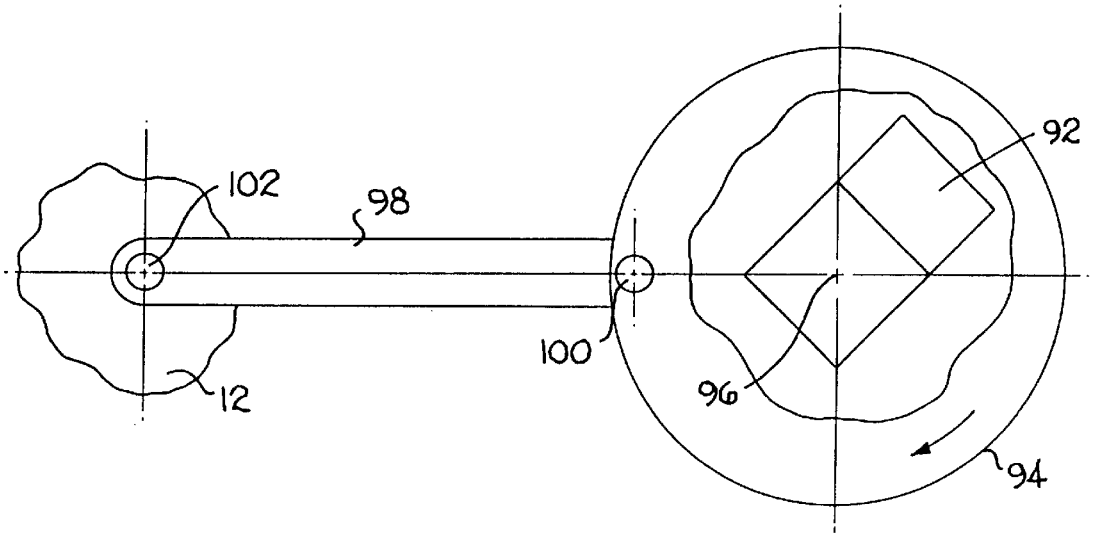
FIG. 8B is an enlarged plan view, partially broken away, showing the timing plate, link, and pin connections of FIG. 3.

As best shown in FIGS. 8A and 8B, there is a link 98, which is pivotably mounted both to the timing plate 94 and to the platform 12 of the first frame 10. The first end of the link 98 is pivotably mounted to the timing plate 94 by a pin 100. The second end of the link 98 is pivotably mounted to the platform 12 of the first frame 10 by a second pin 102. The timing plate 94 is rotated by the second motor 92 in a clockwise direction as shown by the arrow 1 in FIGS. 5–8.

Figure 5:
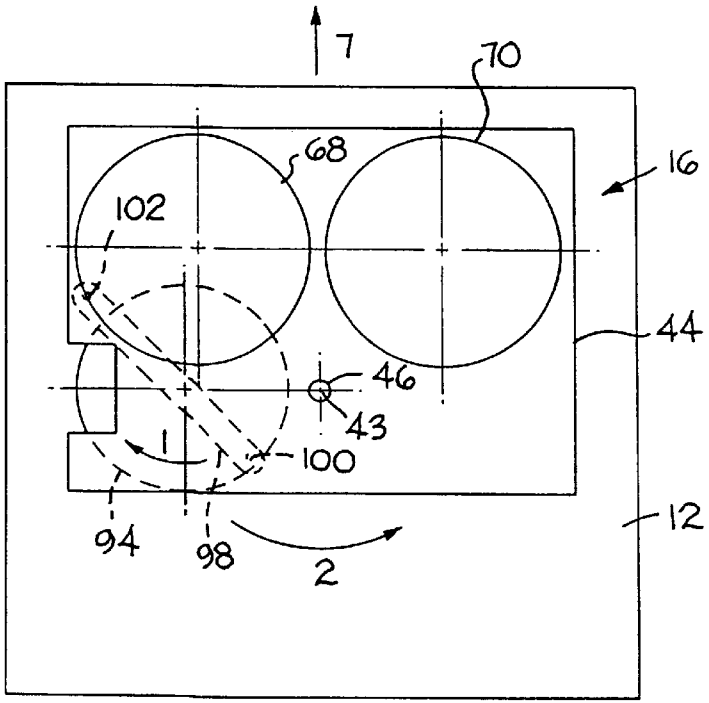
FIG. 5 is a schematic plan view of the ball throwing mechanism of the machine of FIG. 1, wherein the timing plate and ejecting wheels are oriented in a first position.
Figure 8:
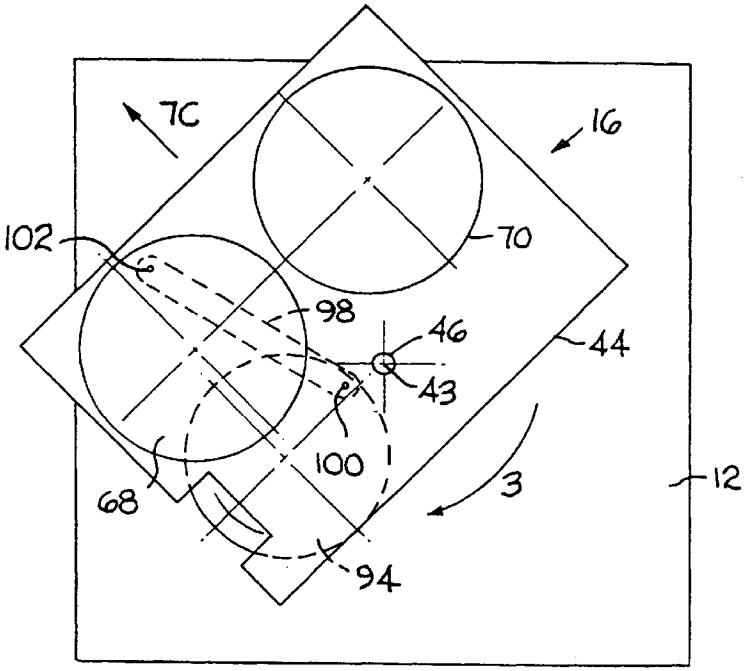
FIG. 8 is a schematic plan view of the ball throwing mechanism of the machine of FIG. 1, wherein the timing plate and ejecting wheels are oriented in a fourth position.

FIG. 5 shows the ball throwing machine in a first position where the throwing machine is aimed in the direction indicated by the arrow 7. This first position preferably corresponds to first base on a baseball diamond. The distance between the pins 100 and 102 (the two ends of the link 98) must always remain the same, because the link 98 has a fixed length. As the timing plate 94 rotates in a clockwise direction, the second frame 16 must move relative to the platform 12 of the first frame 10 in order to keep the distance between the points 100 and 102 constant. The axis 43 is the fixed point about which the second frame 16 pivots relative to the platform 12 of the first frame 10. As the timing plate 94 in FIG. 5 rotates clockwise, as shown by the arrow 1, the link 98 pulls the second frame 16, on which the timing plate 94 and ejecting wheels 68, 70 are mounted, in a counterclockwise direction, as indicated by the arrow 2. After the timing plate 94 rotates 90 degrees clockwise, it reaches a second position, shown in FIG. 6. At this second position, the second frame 16 has rotated 45 degrees counterclockwise, and thus the throwing mechanism is now aimed at second base, as indicated by the arrow 7A. The timing plate 94 continues its clockwise rotation. After it has rotated an additional 90 degrees, it reaches a third position, shown in FIG. 7. In this third position, the second frame 16 has rotated an additional 45 degrees counterclockwise and now aims the throwing mechanism 16 toward third base, as indicated by arrow 7B. Thus, as the timing plate 94 rotates through the first 180 degrees of its clockwise rotation, the second frame 16 rotates through a 90-degree arc counterclockwise, corresponding to, the 90-degree arc between first base and third base on a baseball diamond.

The timing plate 94 continues its clockwise rotation, but, after passing its third position, shown in FIG. 7, the link 98 forces a corresponding clockwise rotation of the second frame 16, as indicated by the arrow 3 in FIG. 7. Thus, as the timing plate 94 rotates clockwise an additional 90 degrees to a fourth position, shown in FIG. 8, the second frame 16 returns to the second base position, as indicated by the arrow 7C. Finally, as the timing plate 94 rotates clockwise an additional 90 degrees to return to its original position, the second frame 16 continues its clockwise rotation until it aims the throwing mechanism again at first base, as shown in FIG. 5. The result is that the second frame 16 and the ejector wheels 68, 70 sweep a 90-degree arc back and forth as the timing plate 94 completes one 360-degree revolution.

Figure 10:
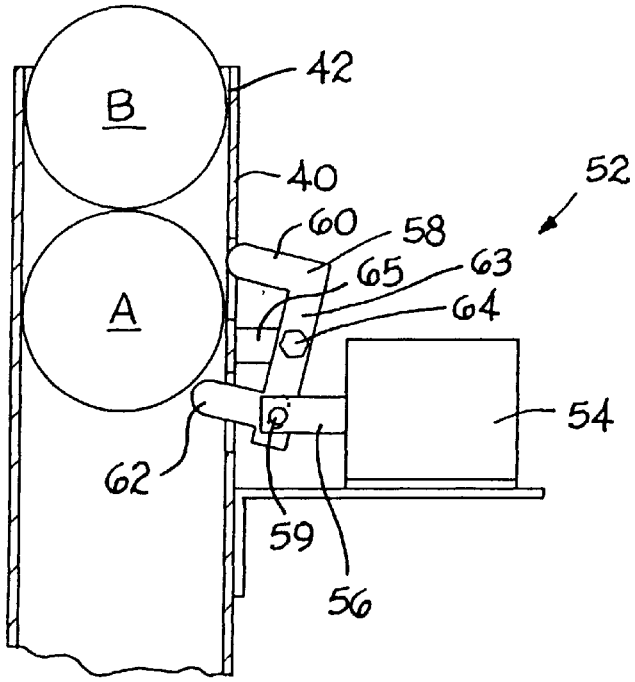
FIG. 10 is an enlarged, side sectional view of the ball release of FIG. 9, wherein the horizontal arm is in its extended stroke position.
Figure 11:
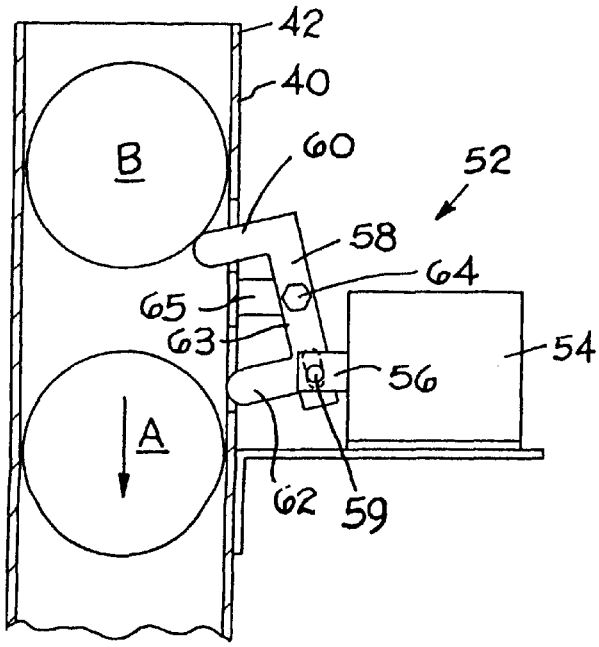
FIG. 11 is an enlarged, side sectional view of the ball release of FIG. 9, wherein the horizontal arm is in its contracted stroke position.

The Ball Release Mechanism:

FIGS. 9, 10, and 11 show the details of the ball release 52, a device which permits only one ball to pass through the ball drop chute 42 at a time. In the preferred embodiment, the ball release 52 is regulated by a solenoid 54. The solenoid 54 extends or retracts a horizontal arm 56. This horizontal arm 56 is pivotally attached to the lower portion of a stop member 58 by a pin 59. The stop member 58 is a C-shaped bar with an upper leg 60, a lower leg 62, and a connecting web 63 connecting together the upper and lower legs 60, 62. The stop member 58 also rotates about a pin 64, which is fixed to the end of an arm 65 that is secured to the ball drop chute 42.

In its static state, the solenoid 54 holds the horizontal arm 56 in an extended position as shown in FIG. 10. In this extended position, the lower leg 62 of the stop member 58 extends through a slot in the wall 40 of the ball drop chute 42, preventing balls from proceeding to the ejecting wheels 68, 70. When the solenoid 54 is activated, the horizontal arm 56 retracts, pivoting the stop member 58 about the pin 64. This extends the upper leg 60 through another slot in the wall 40 of the ball drop chute 42 and retracts the lower leg 62 from the ball drop chute 42 as shown in FIG. 11. When the stop member 58 is pivoted to the position shown in FIG. 11, ball "A" is released and passes through the ball drop chute 42, while ball "B" is prevented from moving down by the upper leg 60 of the stop member 58. The solenoid 54 then quickly extends the horizontal arm 56, retracting the upper leg 60 and extending the lower leg 62 into the ball drop chute 42. Ball "B" then moves down to the position which ball "A" had in FIG. 10, so ball "B" is now ready for the next release. The timer 39 continues to turn the hopper drive motor 38 on and off to rotate the hopper 14, so that balls continue to fall into the upper portion of the ball drop chute 42, above the stop 58. The ball release 52 thus permits only one ball at a time to pass through the ball drop chute 42 and into the ejector wheels 68, 70.

In addition to causing the second frame 16 to rotate relative to the first frame 10, to the timing plate 94 also controls the release of balls at the ball release 52. As shown in FIGS. 4 and 8C, a series of dogs or projections 104 are fixed on the top surface of the timing plate 94. As the timing plate 94 rotates, the projections 104 strike a limit switch 105, mounted on the second frame 16. Each time the limit switch 105 is struck by a projection 104, the switch 105 activates the solenoid 54 of the ball release 52. When the solenoid 54 is activated, it retracts and then extends again, as was explained above, releasing a ball through the ball drop chute 42 into the ejector wheels 68, 70. The dogs 104 are set on the timing plate 94 so that balls are ejected at predetermined angular positions along the sweep of the throwing mechanism 16. Preferably, the angular spacing between the dogs 104 corresponds to balls being ejected toward the first baseman, second baseman, shortstop, and third baseman in turn. The present invention will thus throw ground balls to infielders on a baseball diamond, releasing the balls at predetermined intervals as it sweeps through an arc from first base to third base.

Figure 12:
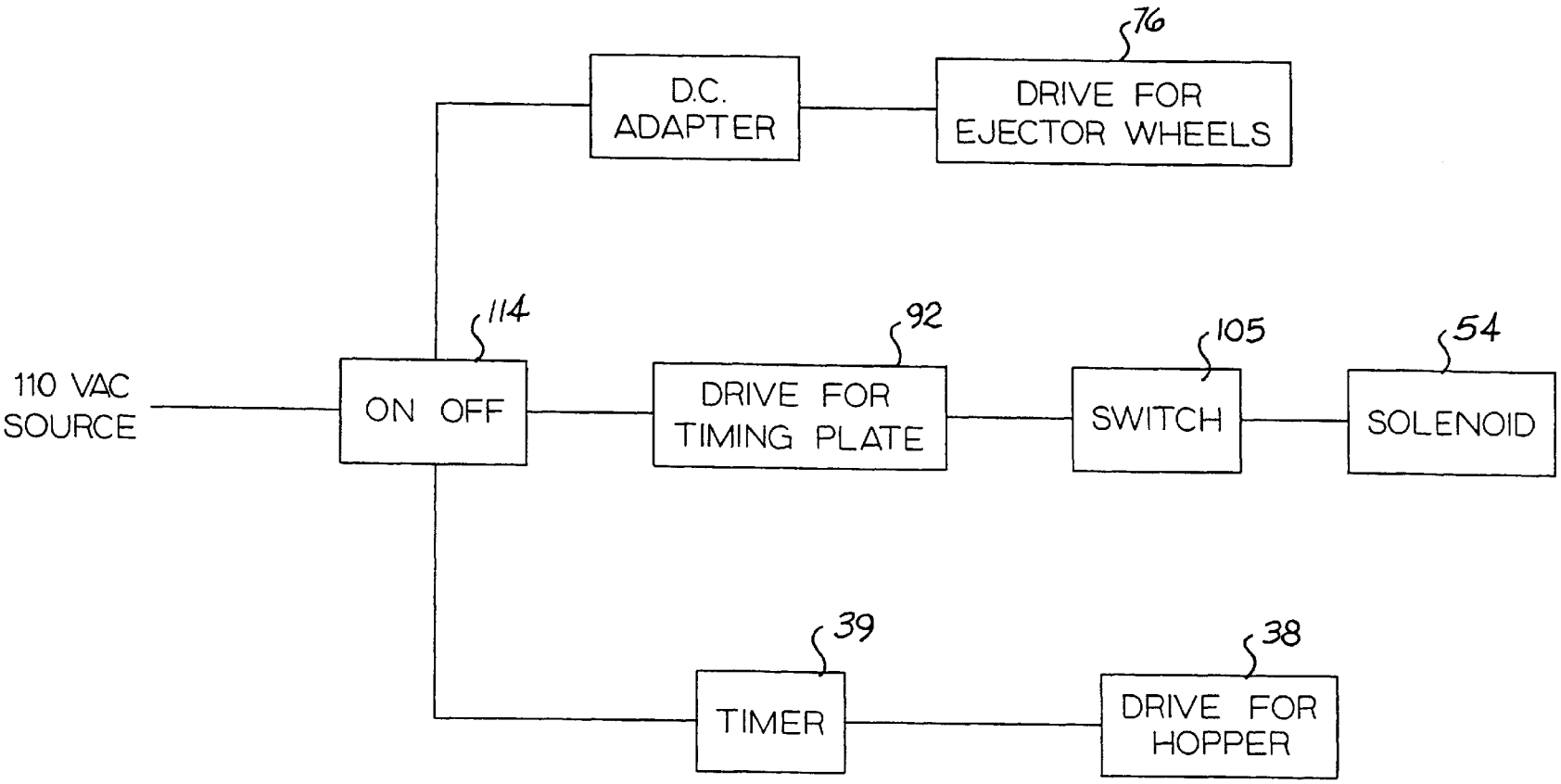
FIG. 12 is a schematic view of the electrical controls of the machine of FIG. 1

FIG. 12 shows schematically the relationship between the drives, timer and solenoid. The machine is plugged into a source of 110-volt alternating current, and the operator turns on an on-off switch 114. This sends power to the drive 76, which drives the ejector wheels 68, 70, and these ejector wheels rotate continuously whenever the machine is turned on. It also sends power to the timing plate drive 92, which drives the timing plate and causes the second frame 16 to pivot in an arc, directing the ejector wheels 68, 70 from first base to third base and back again continuously while the machine is turned on. the dogs or projections 104 on the timing plate 94 contact a switch 105, which causes the solenoid 54 to be activated, releasing one ball each time a projection contacts the switch 105. Power is also sent to a timer 39, which turns the hopper drive 38 on and off so that the hopper ball tubes 30 are sequentially aligned with the ball drop chute 42.

Once the machine is turned on, the coach can focus on coaching the players, and the players will automatically get lots of opportunities for fielding balls, thanks to a relatively simple, inexpensive mechanism that should be affordable for most ball teams.

It will be obvious to those skilled in the art that modifications may be made to the embodiment described above without departing from the scope of the present invention.

What is claimed is:

1. A ball throwing machine, comprising:

a first frame;

a second frame rotatably mounted on said first frame;

first and second ejecting wheels rotatably mounted on said second frame;

a ball hopper mounted adjacent said first and second ejecting wheels for selectively feeding balls thereto;

a first drive operably connected to said first and second ejecting wheels, said first drive rotating said first and second ejecting wheels in opposite directions, wherein said first and second ejecting wheels are positioned on said second frame such that a ball received from said ball hopper is pinched between the first and second ejecting wheels and ejected by the first and second ejecting wheels away from said ball throwing machine;

a second drive that rotates said second frame about a vertical pivot axis relative to said first frame;

a plurality of mechanical trips mounted at preselected locations corresponding to preselected angular positions of said second frame relative to said first frame;

a ball release responsive to said mechanical trips, wherein triggering of one of said mechanical trips causes said ball release to release a ball from said ball hopper into a position between said first and second ejecting wheels; and wherein said second frame includes a table having an undersurface, and wherein said second drive comprises:

a timing plate mounted for rotation on an undersurface of said table;

a motor mounted on said second frame, said motor rotating said timing plate; and a link operably connecting said timing plate to said first frame and having a first end and a second end; said link being pivotably connected to the timing plate at said first end and to the first frame at said second end, wherein rotation of the timing plate causes the rotation of said second frame relative to said first frame.

2. A ball throwing machine as recited in claim 1, wherein said mechanical trips are mounted on said timing plate.

3. A ball throwing machine as recited in claim 2, wherein said first frame includes a platform, and wherein said second frame is a table rotatably mounted on said platform.

4. A ball throwing machine as recited in claim 1, wherein rotation of said timing plate causes said second frame to rotate back and forth through a 90-degree arc relative to said first frame.

5. A ball throwing machine as recited in claim 4, wherein said mechanical trips cause said ball throwing machine to eject balls at positions corresponding to angular positions of infielders on a baseball diamond as said second frame sweeps back and forth through said 90-degree arc from first base to third base.

6. A ball throwing machine, comprising:

a frame;

a ball hopper mounted on said frame;

a platform mounted on said frame below said ball hopper;

a throwing mechanism mounted on said platform; and a ball drop chute extending from said ball hopper into said throwing mechanism;

wherein said throwing mechanism comprises:

a base plate rotatably mounted on said plafform;

a first ejecting wheel rotatably mounted on said base plate;

a second ejecting wheel rotatably mounted on said base plate;

a first drive operably connected to said first and second ejecting wheels, said first drive rotating said first and second ejecting wheels in opposite directions, wherein said first and second ejecting wheels are positioned on said base plate such that, when a ball is received from said ball hopper, it is pinched between the ejecting wheels and ejected away from said ejecting wheels;

a timing plate mounted for rotation on an undersurface of said base plate;

a link operably connecting said timing plate to said platform and having a first end and a second end, said link being pivotably connected to the timing plate at said first end and to the platform at said second end; and a ball release which controls the release of a ball from said hopper through said ball drop chute and into said throwing mechanism;

wherein rotation of the timing plate causes a rotation of the base plate relative to the platform; and wherein said timing plate and said platform include cooperative members that trigger said ball release at preselected angular intervals, thereby causing said ball throwing machine to eject a ball to corresponding preselected angular positions.

7. A ball throwing machine as recited in claim 6, wherein said ball release comprises a stop member, wherein, in a first position, said stop member prevents a ball from passing through said ball drop chute, and, in a second position, said stop member allows a ball to pass through said ball drop chute.

8. A ball throwing machine as recited in claim 7, wherein said ball drop chute defines a wall, and said ball release further comprises:

a solenoid; and an arm operatively connecting said stop member and said solenoid;

wherein said stop member is pivotably attached to said arm and has an upper leg and a lower leg;

wherein, in static state, said solenoid holds said arm in an extended position, extending the lower leg of said stop member through the wall of said ball drop chute, thereby preventing a ball from passing through said ball drop chute; and wherein, when said solenoid is activated, said arm is retracted, causing the upper leg of said stop member to extend through the wall of said ball drop chute while the lower of leg of said stop member is retracted, thereby allowing a ball to pass through said ball drop chute and into a position between said ejecting wheels.

* * * * *